US011788765B2

(12) United States Patent
Lin et al.

(10) Patent No.: US 11,788,765 B2
(45) Date of Patent: Oct. 17, 2023

(54) AIR SWEEPING ASSEMBLY, AIR REGULATING DEVICE AND AIR CONDITIONER

(71) Applicant: Gree Electric Appliances, Inc. of Zhuhai, Zhuhai (CN)

(72) Inventors: Qinghui Lin, Zhuhai (CN); Chunjie Wang, Zhuhai (CN); Min Wang, Zhuhai (CN)

(73) Assignee: GREE ELECTRIC APPLIANCES, INC. OF ZHUHAI, Zhuhai (CN)

( * ) Notice: Subject to any disclaimer, the term of this patent is extended or adjusted under 35 U.S.C. 154(b) by 169 days.

(21) Appl. No.: 16/969,144

(22) PCT Filed: Dec. 10, 2018

(86) PCT No.: PCT/CN2018/120014

§ 371 (c)(1),
(2) Date: Aug. 11, 2020

(87) PCT Pub. No.: WO2019/153868

PCT Pub. Date: Aug. 15, 2019

(65) Prior Publication Data

US 2021/0041133 A1 Feb. 11, 2021
US 2021/0356166 A9 Nov. 18, 2021

(30) Foreign Application Priority Data

Feb. 11, 2018 (CN) ..... 201810141417.8

(51) Int. Cl.
*F24F 13/14* (2006.01)
*F24F 13/15* (2006.01)

(52) U.S. Cl.
CPC ..... *F24F 13/1426* (2013.01); *F24F 13/15* (2013.01)

(58) Field of Classification Search
CPC ..... F24F 13/1426; F24F 13/15; F24F 1/0011; F24F 1/0057; F24F 13/1468; B60H 1/00671; B60H 2001/00721; F16D 1/08
See application file for complete search history.

(56) References Cited

U.S. PATENT DOCUMENTS 4,090,373 A 5/1978 Lang et al.

FOREIGN PATENT DOCUMENTS

CN 201628345 U * 11/2010
CN 201628345 U 11/2010
(Continued)

OTHER PUBLICATIONS

Bayer MaterialScience, Snap-Fit Joints for Plastics, 2012, MIT, p. 6 (Year: 2012).*

(Continued)

*Primary Examiner* — Edelmira Bosques
*Assistant Examiner* — Michael James Giordano
(74) *Attorney, Agent, or Firm* — Armstrong Teasdale LLP

(57) ABSTRACT

Some embodiments of the present disclosure provide an air sweeping assembly, an air regulating device and an air conditioner. The air sweeping assembly includes: a rotation shaft (10), the rotation shaft (10) being provided with blades (20) thereon; a driving device, the driving device including a fixing portion (31) and a driving portion disposed on the fixing portion (31); the driving portion being drivingly connected with the rotation shaft (10), and the driving portion being configured to drive the rotation shaft (10) to rotate; and a first position limiting member (40) disposed on the fixing portion (31); the first position limiting member (40) being configured to define an initial position of the rotation shaft (10) in a circumferential direction.

13 Claims, 5 Drawing Sheets

(56) References Cited

FOREIGN PATENT DOCUMENTS

| | | | | |
|---|---|---|---|---|
| CN | 103528175 | A | * | 1/2014 |
| CN | 103900233 | A | * | 7/2014 |
| CN | 106481679 | A | | 3/2017 |
| CN | 108518834 | A | | 9/2017 |
| CN | 107525149 | A | | 12/2017 |
| CN | 107560135 | A | | 1/2018 |
| CN | 107606765 | A | | 1/2018 |
| CN | 206890770 | U | | 1/2018 |
| CN | 208012029 | U | | 10/2018 |
| KR | 20120127784 | A | | 11/2012 |

OTHER PUBLICATIONS

5 Major Advantages to Using Plastic Injection Molding for the Manufacturing of Parts, Sep. 11, 2014, Paragraphs 1-5, https://nanomoldcoating.com/5-major-advantages-to-using-plastic-injection-molding-for-the-manufacturing-of-parts/ (Year: 2014).*

International Search Report for corresponding PCT/CN2018/120014, dated Feb. 27, 2019, 3 pages.

Supplementary European Search Report for corresponding EP App. No. 18905001.6, dated Feb. 18, 2021, 8 pages.

* cited by examiner

AIR SWEEPING ASSEMBLY, AIR REGULATING DEVICE AND AIR CONDITIONER

CROSS-REFERENCE TO RELATED APPLICATIONS

The present application is a national stage entry of International Patent Application No. PCT/CN2018/120014, filed on Dec. 10, 2018, and claims priority to Chinese Patent Application No. 201810141417.8, filed on Feb. 11, 2018, the contents of which are hereby incorporated by reference in their entirety.

TECHNICAL FIELD

The disclosure relates to a technical field of air conditioners, and in particular to an air sweeping assembly, an air regulating device and an air conditioner.

BACKGROUND

In order to regulate an angle of air blown out from an air conditioner in left and right directions, an air sweeping assembly is usually installed at an air outlet of the air conditioner. Blades of the air sweeping assembly are rotated to achieve left-right air sweeping. In order to control a rotation angle of the blades conveniently, it is necessary to design a position limiting structure to limit an initial position of the blades in rotation process. At the same time, in order to regulate an angle of the air blown out from the air conditioner in a height direction, an air guiding assembly is usually installed at the air outlet of the air conditioner, and an air direction is regulated through swinging of the air guiding assembly.

In an art known to inventors, there is an air regulating device capable of connecting the air sweeping assembly and the air guiding assembly, in this device, a position limiting structure is designed on the air guiding assembly, and the initial position of the blades is limited by the position limiting structure. However, there is a defect in this solution: because an air guiding plate is swung, a design of the position limiting structure on a moving air guiding plate is not easy to limit the initial position of the blades, and such a structure also causes a program for controlling the blades to find the initial position to be quite complicated.

SUMMARY

Some embodiments of the present disclosure provide an air sweeping assembly, an air regulating device and an air conditioner, so as to solve a problem in a art known to inventors that an initial position of blades of the air sweeping assembly is not easily defined.

According to one aspect of some embodiments of the disclosure, an air sweeping assembly is provided, the air sweeping assembly includes: a rotation shaft, the rotation shaft being provided with blades; a driving device, the driving device including a fixing portion and a driving portion disposed on the fixing portion; the driving portion being drivingly connected with the rotation shaft, and the driving portion being configured to drive the rotation shaft to rotate; and a first position limiting member disposed on the fixing portion; the first position limiting member being configured to define an initial position of the rotation shaft in a circumferential direction.

In some embodiments, the air sweeping assembly further includes: a second position limiting member disposed on the rotation shaft, the second position limiting member being configured to contact with the first position limiting member so as to define the initial position of the rotation shaft in the circumferential direction.

In some embodiments, the first position limiting member includes: a first connecting section, protrudingly disposed on the fixing portion and disposed on the fixing portion; and a first extending section, connected with the first connecting section, the first extending section being extended along an axial direction of the rotation shaft, and the first extending section being configured to abut against the second position limiting member.

In some embodiments, the second position limiting member includes: a second connecting section, protrudingly disposed on the rotation shaft and disposed on the rotation shaft; and a second extending section, connected with the second connecting section, the second extending section being extended along the axial direction of the rotation shaft, and the second extending section being configured to abut against the first position limiting member.

In some embodiments, the fixing portion includes: a housing, at least part of the driving portion being disposed in the housing; and a shaft sleeve, connected with the housing, the first position limiting member being protrudingly disposed on the shaft sleeve and disposed on the shaft sleeve, and a driving shaft of the driving portion being passed through the shaft sleeve.

In some embodiments, a driving shaft of the driving portion is provided with a slot, an inside of the slot is provided with a first limiting surface, an end part of the rotation shaft is provided with a plug, the plug is provided with a second limiting surface, the plug is in insert-connection with the slot, and the first limiting surface is cooperated with the second limiting surface.

In some embodiments, the inside of the slot is provided with a plurality of first limiting surfaces, an outer side of the plug is provided with a plurality of second limiting surfaces, the plurality of second limiting surfaces are in cooperative-connection with the plurality of first limiting surfaces each other in an one-to-one correspondence manner.

In some embodiments, the air sweeping assembly further includes: a locking button, disposed at one end, adjacent to the driving portion, of the rotation shaft, wherein, a driving shaft of the driving portion is provided with a lug boss, the locking button is in locking-connection with the lug boss so as to prevent the rotation shaft from being axially moved relative to the driving shaft.

In some embodiments, the locking button includes: a cantilever, protrudingly disposed on the rotation shaft and disposed on the rotation shaft; and a locking hook, connected with the cantilever, wherein, the locking hook is in locking-connection with the lug boss.

In some embodiments, the locking button further includes: a handle, one end of the handle is connected with the locking hook, and the other end of the handle is a free end, the handle and the locking hook are respectively positioned at both sides of the cantilever.

According to another aspect of some embodiments of the present disclosure, an air regulating device is provided, and the air regulating device includes an air guiding assembly and the abovementioned air sweeping assembly, the rotation shaft of the air sweeping assembly is disposed on the air guiding assembly.

According to another aspect of some embodiments of the disclosure, an air conditioner is provided, and the air conditioner includes the above-mentioned air regulating device.

A technical solution of some embodiments of the disclosure is applied, to enable the first position limiting member of the air sweeping assembly to be disposed on the fixing portion of a driving device, and the initial position of the rotation shaft in the circumferential direction is defined by the first position limiting member. Because the first position limiting member is positioned on a stationary fixing portion, the position of the first position limiting member is stationary, whenever the rotation shaft is rotated to a position in which the rotation shaft is contacted with the first position limiting member, the rotation shaft has a defined known position, the position is used as an initial position of the rotation shaft and the blades, so that the initial position of the blades is defined conveniently, and a rotation angle of the blades is regulated conveniently.

BRIEF DESCRIPTION OF THE DRAWINGS

The drawings of the description forming a part of some embodiments of the present disclosure are used to provide further understanding of the disclosure, the schematic embodiments of the disclosure and descriptions thereof are used to explain the disclosure, and do not form improper limitation to the disclosure. In the drawings.

Figure 1:
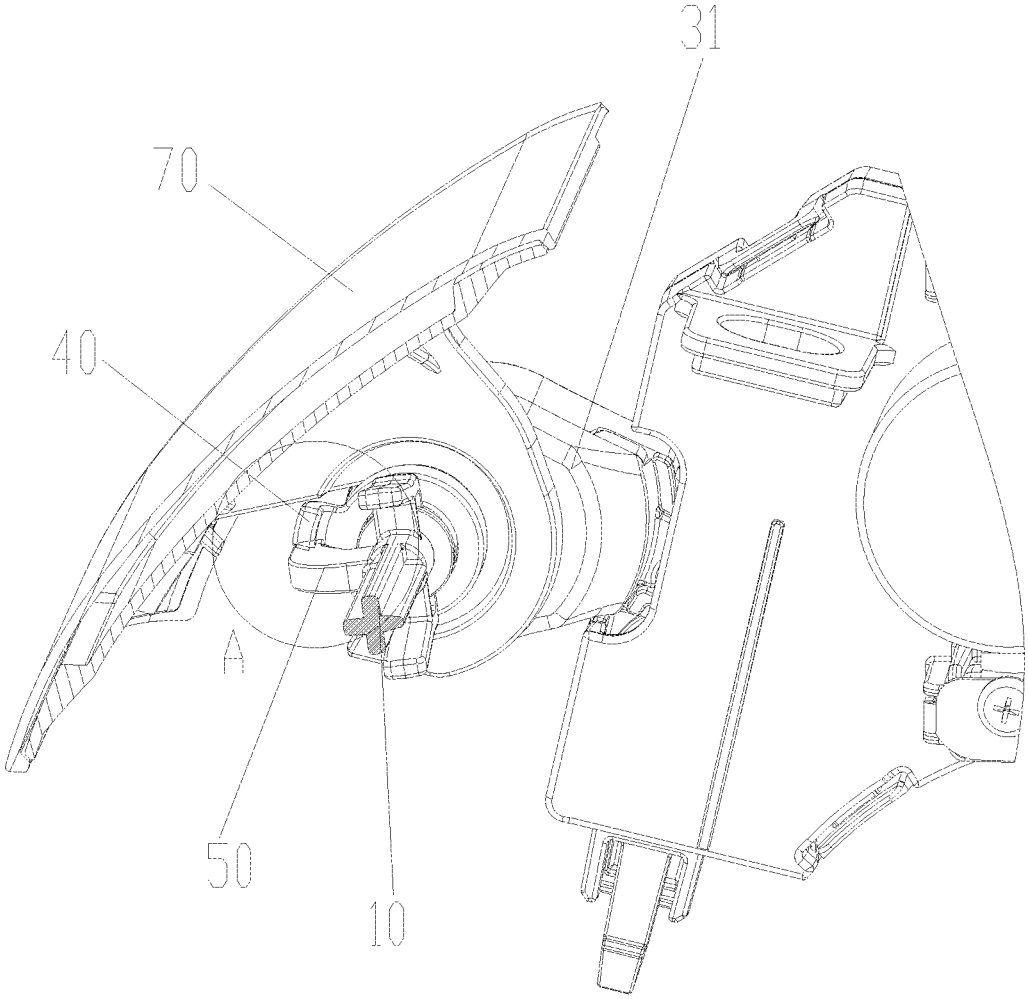
FIG. 1 illustrates a structure schematic diagram of an air regulating device provided by some embodiments of the disclosure.

Herein, the above drawings include the following reference signs.

10. rotation shaft; 11. plug; 20. blade; 31. fixing portion; 31*a*. housing; 31*b*. shaft sleeve; 32. driving shaft; 32*a*. slot; 32*b*. lug boss; 40. first position limiting member; 41. first connecting section; 42. first extending section; 50. second position limiting member; 51. second connecting section; 52. second extending section; 60. locking button; 61. cantilever; 62. locking hook; 63. handle; and 70. air guiding assembly.

DETAILED DESCRIPTION OF THE EMBODIMENTS

Technical solutions in the embodiments of the disclosure are clearly and completely described below in combination with the drawings in the embodiments of the disclosure. It is apparent that the embodiments described are only a part of the embodiments of the disclosure, but not all of the embodiments. The following description to at least one exemplary embodiment is actually merely illustrative, and is in no way served as any limitation to the disclosure and disclosure or use thereof. Based on the embodiments of the disclosure, all other embodiments obtained by those of ordinary skill in the art without making creative work shall fall within a scope of protection of the disclosure.

As shown in FIG. 1 to FIG. 5, the embodiment of the disclosure provides an air sweeping assembly, including: a rotation shaft 10, wherein the rotation shaft 10 is provided with blades 20; a driving device, wherein the driving device includes a fixing portion 31 and a driving portion disposed on the fixing portion 31; the driving portion is drivingly connected with the rotation shaft 10, and the driving portion is configured to drive the rotation shaft 10 to rotate; and a first position limiting member 40 disposed on the fixing portion 31; wherein the first position limiting member 40 is configured to define an initial position of the rotation shaft 10 in a circumferential direction.

The technical solution of some embodiments is applied, to enable the first position limiting member 40 of the air sweeping assembly to be disposed on the fixing portion of the driving device, and the initial position of the rotation shaft 10 in the circumferential direction is defined by the first position limiting member 40. Because the first position limiting member 40 is positioned on a stationary fixing portion 31, the position of the first position limiting member 40 is stationary, whenever the rotation shaft 10 is rotated to a position in which the rotation shaft is contacted with the first position limiting member 40, the rotation shaft 10 has a defined known position, a position is used as the initial position of the rotation shaft 10 and the blades 20, so that the initial position of the blades 20 is defined conveniently, and a rotation angle of the blades 20 is regulated conveniently. In addition, such a structure is used so that a program for controlling the blades 20 to find the initial position can also be set simply.

In this way, no matter where the blades 20 are positioned while the whole air conditioner is started, it is necessary to start rotation calculation from the initial position, and then rotated to a predetermined angle to be achieved to perform the air sweeping. The first position limiting member 40 in some embodiments is a static reference object without motion properties, it is great convenient to find the initial position for the blades 20, thereby the control program of the blades 20 can be simplified, and a fixed-angle air sweeping of the blades 20 is achieved.

Figure 2:
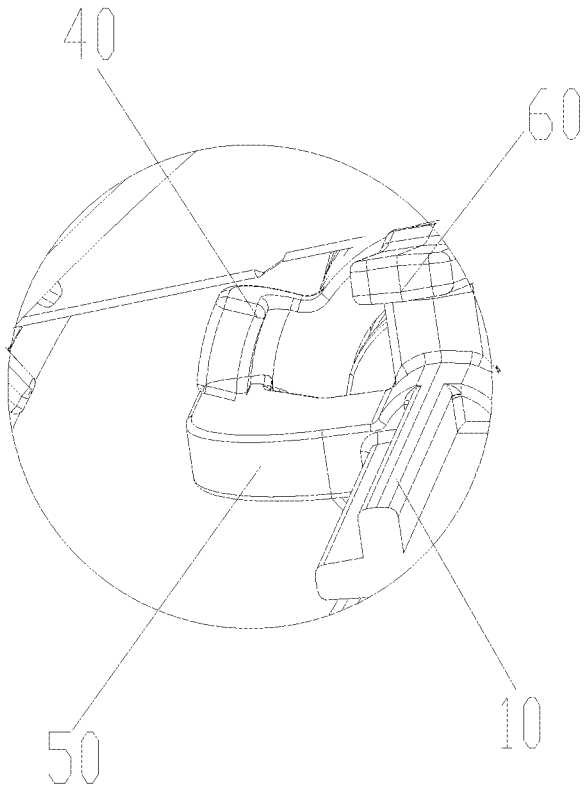
FIG. 2 illustrates a partial enlarged diagram of a position A in FIG. 1.

As shown in FIG. 1 and FIG. 2, the air sweeping assembly further includes: a second position limiting member 50 disposed on the rotation shaft 10, wherein the second position limiting member 50 is configured to contact with the first position limiting member 40 so as to define the initial position of the rotation shaft 10 in the circumferential direction. In such setting, while the rotation shaft 10 is rotated to a certain position, the second position limiting member 50 is contacted with the first position limiting member 40, so as to prevent the rotation shaft 10 from being continuously rotated, this position is served as an initial position of the rotation shaft 10 and the blades 20. In this way, while the initial position of the blades 20 is required to be defined, just the rotation shaft 10 is rotated. When the second position limiting member 50 is contacted with the first position limiting member 40, the initial position is acquired, so that the initial position of the blades 20 is defined conveniently, and a rotation angle of the blades 20 is regulated conveniently.

Figure 3:
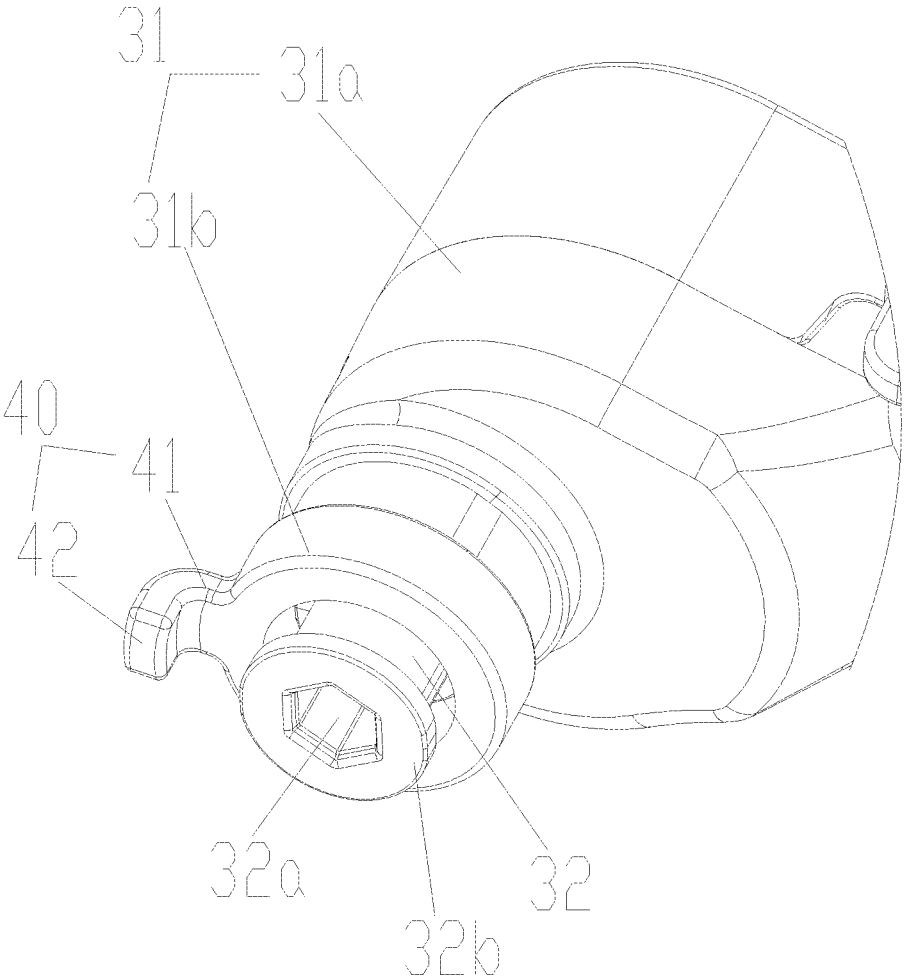
FIG. 3 illustrates a structure schematic diagram of a first position limiting member in FIG. 1.

In some embodiments, as shown in FIG. 3, the first position limiting member 40 includes: a first connecting section 41, protrudingly disposed on the fixing portion and disposed on the fixing portion 31; and a first extending section 42, connected with the first connecting section 41, wherein the first extending section 42 is extended along an axial direction of the rotation shaft 10, and the first extending section 42 is configured to abut against the second position limiting member 50. In such setting, the first position limiting member 40 is contacted with the second position limiting member 50 conveniently, thereby the initial position of the rotation shaft 10 and the blades 20 is defined conveniently.

Figure 4:
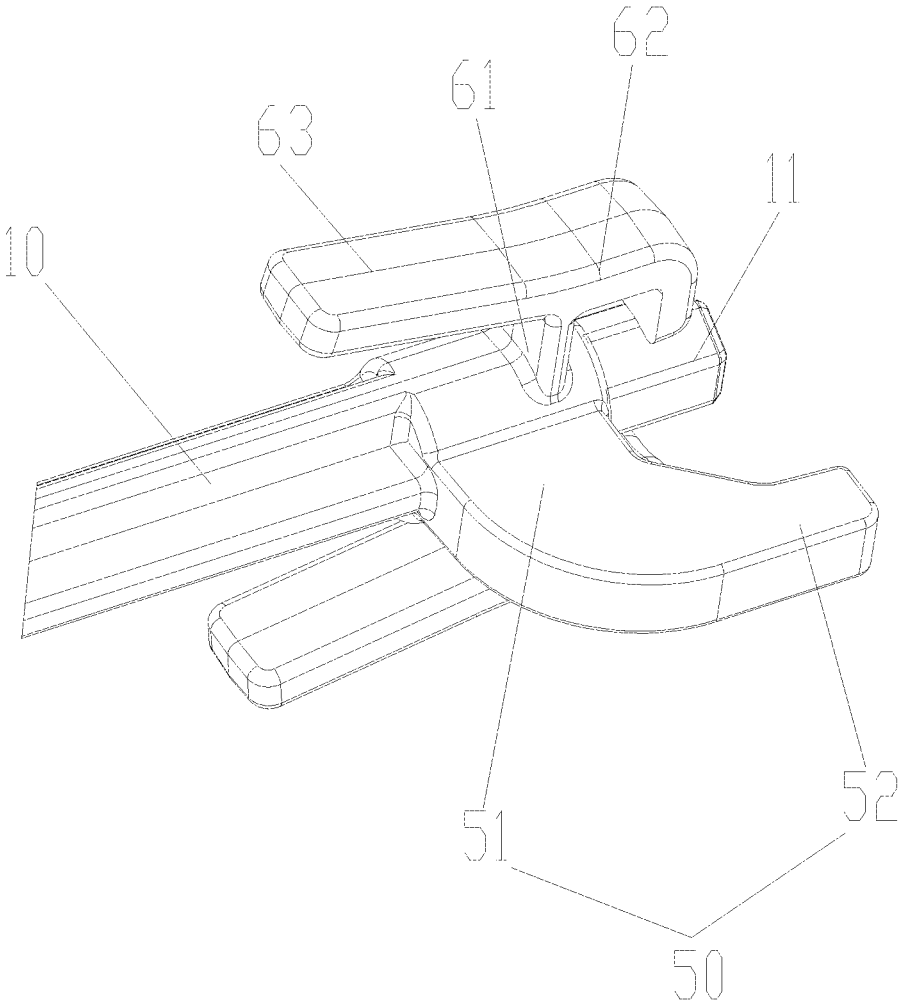
FIG. 4 illustrates a structure schematic diagram of a second position limiting member in FIG. 1.
Figure 5:
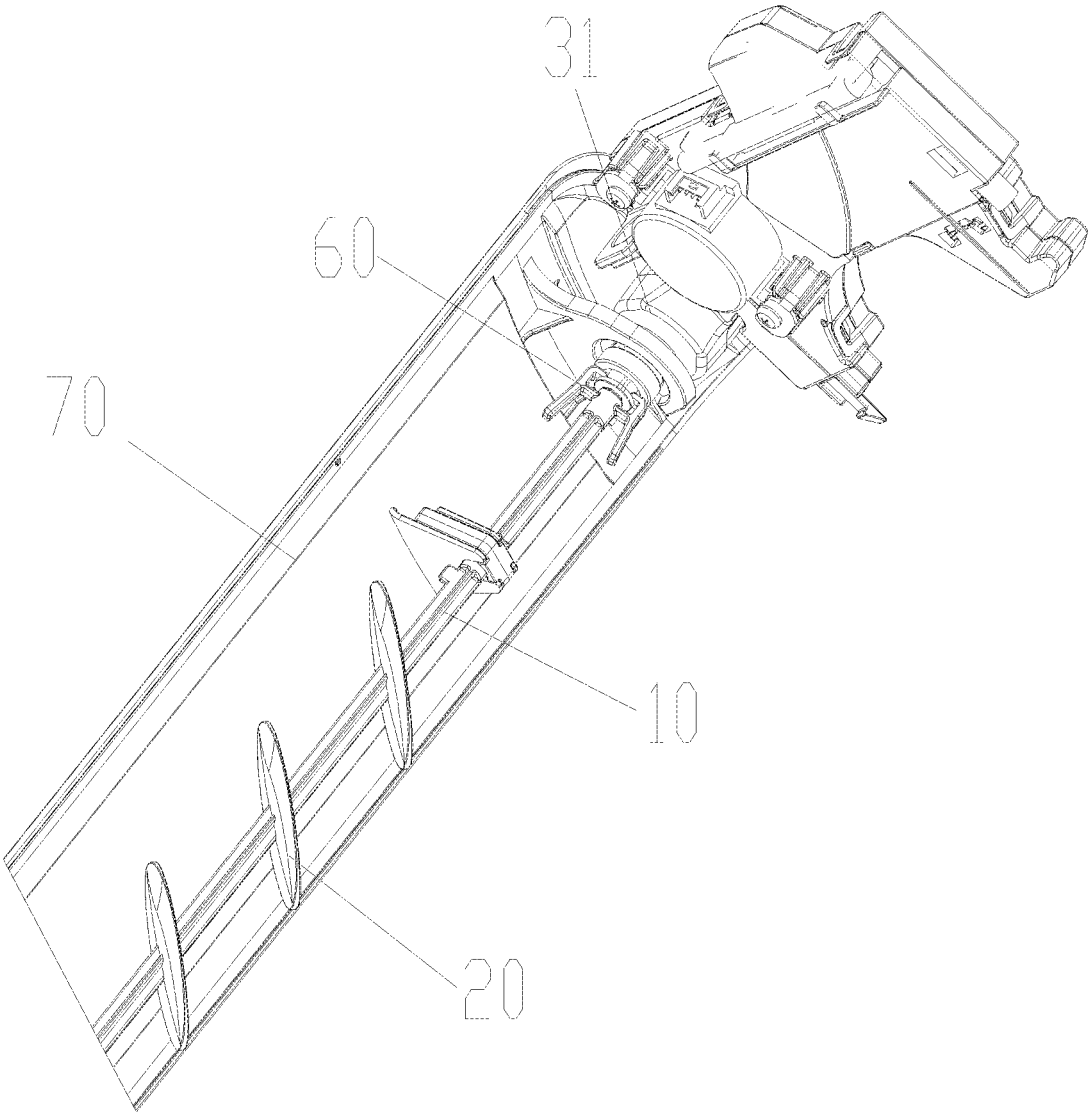
FIG. 5 illustrates another view of the air regulating device in FIG. 1.

As shown in FIG. 4, the second position limiting member 50 includes: a second connecting section 51, protrudingly disposed on the rotation shaft and disposed on the rotation shaft 10; and a second extending section 52, connected with the second connecting section 51, wherein the second extending section 52 is extended along the axial direction of the rotation shaft 10, and the second extending section 52 is configured to abut against the first position limiting member 40. In such setting, the first position limiting member 40 is contacted with the second position limiting member 50 conveniently, thereby the initial position of the rotation shaft 10 and the blades 20 is defined conveniently. In some embodiments, while the rotation shaft 10 is rotated to the initial position, the first extending section 42 of the first position limiting member 40 is contacted with the second extending section 52 of the second position limiting member 50, thereby the rotation shaft 10 is limited in the initial position, after the initial position is defined, the rotation angle of the blades 20 is regulated conveniently.

As shown in FIG. 3, the fixing portion 31 includes: a housing 31*a*, wherein at least part of the driving portion is disposed in the housing 31*a*, and a shaft sleeve 31*b*, connected with the housing 31*a*, wherein the first position limiting member 40 is protrudingly disposed on the shaft sleeve and disposed on the shaft sleeve 31*b*, and a driving shaft 32 of the driving portion is passed through the shaft sleeve 31*b*. In this way, the first position limiting member 40 is conveniently installed and an avoidance is performed on the driving shaft 32 of the driving portion.

In some embodiments, an inside of the slot 32*a* is provided with a plurality of first limiting surfaces, an outer side of the plug 11 is provided with a plurality of second limiting surfaces, the plurality of second limiting surfaces are in cooperative-connection with the plurality of first limiting surfaces each other. In such setting, the connection reliability of the rotation shaft 10 and the driving shaft 32 is improved, and the rotation shaft 10 and the driving shaft 32 are prevented from being relatively moved, so that the torque is transferred better. For example, in some embodiments, a cross section of the slot 32*a* and a cross section of the plug 11 are set as mutually matched hexagonal structures.

In order to improve a connection strengthen of the rotation shaft 10 and the driving shaft 32, in some embodiments, the air sweeping assembly further includes: a locking button 60, disposed at one end, adjacent to the driving portion, of the rotation shaft 10, wherein, the driving shaft 32 of the driving portion is provided with a lug boss 32*b*, the locking button 60 is in locking-connection with the lug boss 32*b* so as to prevent the rotation shaft 10 from being axially moved relative to the driving shaft 32. In such setting, the rotation shaft 10 is prevented from being axially moved relative to the driving shaft 32 by a locking-connection of the locking button 60 and the lug boss 32*b*, thereby a reliability of the sweeping assembly is guaranteed. In addition, a connection manner of the locking-connection is convenient to the assembly of the sweeping assembly.

In order to improve a connection strengthen of the rotation shaft 10 and the driving shaft 32, in some embodiments, the air sweeping assembly further includes: a locking button 60, disposed at one end, adjacent to the driving portion, of the rotation shaft 10, wherein, the driving shaft 32 of the driving portion is provided with a lug boss 32*b*, the locking button 60 is in locking-connection with the lug boss 32*b* so as to prevent the rotation shaft 10 from being axially moved relative to the driving shaft 32. In such setting, the rotation shaft 10 is prevented from being axially moved relative to the driving shaft 32 by a locking-connection of the locking button 60 and the lug boss 32*b*, thereby a reliability of a device is guaranteed. In addition, a connection manner of the locking-connection is convenient to the assembly of the device.

As shown in FIG. 4, the locking button 60 includes: a cantilever 61, protrudingly disposed on the rotation shaft 10 and disposed on the rotation shaft 10; and a locking hook 62, connected with the cantilever 61, wherein, the locking hook 62 is in locking-connection with the lug boss 32*b*. In this way, enough space is reserved to install the locking button 60 conveniently. After the locking hook 62 is in locking-connection with the lug boss 32*b*, a connecting part of the lug boss 32*b* is positioned in an area between the cantilever 61 and the locking hook 62.

In some embodiments, the locking button 60 further includes: a handle 63, one end of the handle 63 is connected with the locking hook 62, and the other end of the handle 63 is a free end, the handle 63 and the locking hook 62 are respectively positioned at both sides of the cantilever 61. In this way, the handle 63, the cantilever 61 and the locking hook 62 form a leverage effect, in operation, the handle 63 is pressed so that the handle 63 is moved to a direction adjacent to the rotation shaft 10, thereby the locking hook 62 is moved to a direction away from the rotation shaft 10, in this way, the locking hook 62 has enough avoidance space to connect or disconnect with the lug boss 32*b*. So, it is convenient to an assembly of the rotation shaft 10 and the driving shaft 32 by the technical solution of some embodiments of the present disclosure.

In order to improve the connection strength of the rotation shaft 10 and the driving shaft 32, in some embodiments of the present disclosure, two symmetric locking buttons 60 are installed, and the two locking buttons 60 are respectively connected with the lug boss 32*b*. In addition, in some embodiments, after the locking hook 62 is connected with the lug boss 32*b*, the shaft sleeve 31*b* also has a limiting effect on the locking hook 62. In some embodiments, the locking button 60 is made of an elastic material. For example, the locking buttons 60 and the rotation shaft 10 are integrally injection-formed by using a plastic material.

Some embodiments of the present disclosure further provides an air regulating device, the air regulating device includes an air guiding assembly 70 and the above mentioned air sweeping assembly, a rotation shaft 10 of the air sweeping assembly is disposed on the air guiding assembly 70. The technical solution of the embodiments is applied, to enable the first position limiting member 40 of the air sweeping assembly to be disposed on the fixing portion 31 of the driving device, and the initial position of the rotation shaft 10 in the circumferential direction is defined by the first position limiting member 40. Because the first position limiting member 40 is positioned on the stationary fixing portion 31, the position of the first position limiting member 40 is stationary, whenever the rotation shaft 10 is rotated to a position in which the rotation shaft 10 is contacted with the first position limiting member 40, the rotation shaft 10 has a defined known position, the position is used as the initial position of the rotation shaft 10 and the blades 20, so that the initial position of the blades 20 is defined conveniently, and a rotation angle of the blades 20 is regulated conveniently. The air regulating device is set to include the air sweeping assembly and the air guiding assembly 70, a same set of the device can be used to achieve the regulation of air blown out from the air conditioner in left-right direction and upward-downward direction, thereby the comfort level of a user is improved and the air regulating device is enabled to be more compact.

Some embodiments of the present disclosure provide an air conditioner. The air conditioner includes an air regulating device, the air regulating device is the air regulating device provided by the above embodiments. By using the air conditioner, the initial position of the blades 20 is defined conveniently, thereby the rotation angle of the blades 20 is regulated conveniently.

The above are only the embodiments of the disclosure, and are not intended to limit the disclosure, for those skilled in the art, the disclosure have various modifications and changes. Any modifications, equivalent replacements, improvements and the like made within the spirit and principle of the disclosure shall be included in a scope of protection of the disclosure.

What is claimed is:

1. An air sweeping assembly, comprising:

a rotation shaft, the rotation shaft being provided with blades;

a driving device, wherein the driving device comprises a fixing portion and a driving portion disposed on the fixing portion; the driving portion is drivingly connected with the rotation shaft, and the driving portion is configured to drive the rotation shaft to rotate; and a first position limiting member disposed on the fixing portion, wherein the first position limiting member is configured to define an initial position of the rotation shaft in a circumferential direction;

wherein the fixing portion comprises:

a housing, at least part of the driving portion being disposed in the housing; and a shaft sleeve, connected with the housing, the first position limiting member being protrudingly disposed on the shaft sleeve, and a driving shaft of the driving portion being passed through the shaft sleeve;

a locking button, disposed at one end, adjacent to the driving portion, of the rotation shaft, wherein, a driving shaft of the driving portion is provided with a lug boss, the locking button is in locking-connection with the lug boss so as to prevent the rotation shaft from being axially moved relative to the driving shaft;

wherein the locking button comprises:

a cantilever, protrudingly disposed on the rotation shaft and disposed on the rotation shaft; and a locking hook, connected with the cantilever, wherein, the locking hook is in locking-connection with the lug boss;

wherein the locking button further comprises:

a handle, one end of the handle is connected with the locking hook, and the other end of the handle is a free end, the handle and the locking hook are respectively positioned at both sides of the cantilever;

the locking buttons and the rotation shaft are integrally injection-formed by using a plastic material;

the locking button is made of an elastic material;

after the locking hook is connected with the lug boss, the shaft sleeve also limits the locking hook.

2. The air sweeping assembly as claimed in claim 1, further comprising:

a second position limiting member disposed on the rotation shaft, the second position limiting member being configured to contact with the first position limiting member, so as to define the initial position of the rotation shaft in the circumferential direction.

3. The air sweeping assembly as claimed in claim 2, wherein the first position limiting member comprises:

a first connecting section, protrudingly disposed on the fixing portion; and a first extending section, connected with the first connecting section, the first extending section being extended along an axial direction of the rotation shaft, and the first extending section being configured to abut against the second position limiting member.

4. The air sweeping assembly as claimed in claim 2, wherein the second position limiting member comprises:

a second connecting section, protrudingly disposed on the rotation shaft; and a second extending section, connected with the second connecting section, the second extending section being extended along the axial direction of the rotation shaft, and the second extending section being configured to abut against the first position limiting member.

5. The air sweeping assembly as claimed in claim 1, wherein a driving shaft of the driving portion is provided with a slot, an inside of the slot is provided with a first limiting surface, an end part of the rotation shaft is provided with a plug, the plug is provided with a second limiting surface, the plug is in insert-connection with the slot, and the first limiting surface is cooperated with the second limiting surface.

6. The air sweeping assembly as claimed in claim 5, wherein the inside of the slot is provided with a plurality of first limiting surfaces, an outer side of the plug is provided with a plurality of second limiting surfaces, the plurality of second limiting surfaces are in cooperative-connection with the plurality of first limiting surfaces in a one-to-one correspondence manner.

7. An air regulating device, comprising an air guiding assembly and an air sweeping assembly as claimed in claim 1, wherein, the rotation shaft of the air sweeping assembly is disposed on the air guiding assembly.

8. An air conditioner, comprising the air regulating device as claimed in claim 7.

9. The air regulating device as claimed in claim 7, wherein, the air sweeping assembly further comprises:

a second position limiting member disposed on the rotation shaft, the second position limiting member being configured to contact with the first position limiting member, so as to define the initial position of the rotation shaft in the circumferential direction.

10. The air regulating device as claimed in claim 9, wherein the first position limiting member comprises:

a first connecting section, protrudingly disposed on the fixing portion and disposed on the fixing portion; and a first extending section, connected with the first connecting section, the first extending section being extended along an axial direction of the rotation shaft, and the first extending section being configured to abut against the second position limiting member.

11. The air regulating device as claimed in claim 9, wherein the second position limiting member comprises:

a second connecting section, protrudingly disposed on the rotation shaft and disposed on the rotation shaft; and a second extending section, connected with the second connecting section, the second extending section being extended along the axial direction of the rotation shaft, and the second extending section being configured to abut against the first position limiting member.

12. The air regulating device as claimed in claim 7, wherein a driving shaft of the driving portion is provided with a slot, an inside of the slot is provided with a first limiting surface, an end part of the rotation shaft is provided with a plug, the plug is provided with a second limiting surface, the plug is in insert-connection with the slot, and the first limiting surface is cooperated with the second limiting surface.

13. The air regulating device as claimed in claim 12, wherein the inside of the slot is provided with a plurality of first limiting surfaces, an outer side of the plug is provided with a plurality of second limiting surfaces, the plurality of second limiting surfaces are in cooperative-connection with the plurality of first limiting surfaces in a one-to-one correspondence manner.

* * * * *